US008656620B2

(12) United States Patent
Hankel et al.

(10) Patent No.: US 8,656,620 B2
(45) Date of Patent: Feb. 25, 2014

(54) BREECH FOR A REPEATING FIREARM

(75) Inventors: Willi Hankel, Isny (DE); Bastian Rothe, Weitnau-Kleinweiler (DE)

(73) Assignee: Blaser Finanzholding GmbH, Isny (DE)

( * ) Notice: Subject to any disclaimer, the term of this patent is extended or adjusted under 35 U.S.C. 154(b) by 16 days.

(21) Appl. No.: 13/305,409

(22) Filed: Nov. 28, 2011

(65) Prior Publication Data

US 2012/0204463 A1 Aug. 16, 2012

(30) Foreign Application Priority Data

Feb. 10, 2011 (DE) ..... 20 2011 002 579 U

(51) Int. Cl.
*F41A 19/34* (2006.01)
*F41A 3/12* (2006.01)

(52) U.S. Cl.
USPC ..... 42/69.02

(58) Field of Classification Search
USPC ..... 42/69.01, 69.02, 69.03, 16, 14; 89/27.11
See application file for complete search history.

(56) References Cited

U.S. PATENT DOCUMENTS

| | | | | | |
|---|---|---|---|---|---|
| 1,108,400 | A * | 8/1914 | Savage | 42/21 |
| 2,818,669 | A * | 1/1958 | Claude et al. | 42/16 |
| 3,234,679 | A * | 2/1966 | Benson | 42/70.06 |
| 3,857,324 | A * | 12/1974 | Tant | 89/197 |
| 3,892,082 | A * | 7/1975 | Domhan | 42/11 |
| 3,949,508 | A * | 4/1976 | Elkas | 42/69.03 |
| 4,270,295 | A * | 6/1981 | Grehl | 42/70.08 |
| 4,569,145 | A * | 2/1986 | Ruger et al. | 42/16 |
| 5,458,046 | A * | 10/1995 | Blenk et al. | 89/190 |
| 5,465,518 | A * | 11/1995 | Blaser | 42/70.08 |
| 6,796,067 | B2 * | 9/2004 | Popikow | 42/42.01 |
| 7,185,454 | B2 | 3/2007 | Popikow | |
| 7,347,021 | B1 * | 3/2008 | Jones | 42/10 |
| 7,644,530 | B2 * | 1/2010 | Scherpf | 42/117 |
| 7,908,779 | B2 * | 3/2011 | Wasmer | 42/1.05 |
| 2001/0016997 | A1 * | 8/2001 | Zeh et al. | 42/16 |
| 2005/0188577 | A1 | 9/2005 | Popikow | |

FOREIGN PATENT DOCUMENTS

| | | | |
|---|---|---|---|
| DE | 29715238 | U1 | 10/1997 |
| DE | 10332962 | B3 | 9/2004 |
| DE | 202005019384 | U1 | 4/2006 |
| DE | 102007043628 | A1 | 3/2009 |
| DE | 102008021690 | A1 | 11/2009 |

* cited by examiner

*Primary Examiner* — Bret Hayes
(74) *Attorney, Agent, or Firm* — Fleit Gibbons Gutman Bongini & Bianco PL; Martin Fleit; Paul D. Bianco

(57) ABSTRACT

The invention pertains to a breech of a repeating firearm with a bolt assembly that is guided within a housing such that it is rotatable about its longitudinal axis and is axially displaceable in the longitudinal direction of the firearm, a striking pin that is axially movable in the bolt assembly and a breech block that is arranged on the rear end of the bolt assembly and in which a cocking mechanism is accommodated that can be actuated with an actuating element and serves for tensioning and relaxing a striking pin spring acting upon the striking pin. The actuating element consists of a cocking slide that can be displaced between a lower relaxed position and an upper tensioned position on the rear side of the breech block.

20 Claims, 6 Drawing Sheets

BREECH FOR A REPEATING FIREARM

CROSS REFERENCE TO RELATED APPLICATION

This application claims priority under 35 U.S.C. §119 to German Patent Application No. 20 2011 002 579.9 filed Feb. 10, 2011, the entire contents of which are incorporated herein by reference.

FIELD OF THE INVENTION

The present invention relates to a breech for a repeating firearm.

BACKGROUND OF THE INVENTION

A breech of this type is known from DE 103 32 962 B3. The breech disclosed in this publication features a bolt assembly that is guided within a housing such that it is rotatable about its longitudinal axis and axially displaceable in the longitudinal direction of the firearm, a striking pin that is axially movable in the bolt assembly and a breech block that is arranged on the rear end of the bolt assembly and in which a cocking mechanism is accommodated that can be actuated with an actuating element and serves for tensioning and relaxing a striking pin spring acting upon the striking pin. In this known breech, the actuating element consists of a cocking lever that is rotatable within the breech block about a bearing pin arranged perpendicular to the longitudinal axis of the firearm and can be turned by means of a rearwardly protruding handle part. An articulated lever in the form of a crank-and-rocker linkage is coupled to a disk-shaped part of the cocking lever. This articulated lever is engaged with a tensioning rod, by means of which the striking pin spring can be respectively tensioned and relaxed.

SUMMARY OF THE INVENTION

It is the objective of the invention to develop a breech, and a repeating firearm containing such a breech, which feature a compactly designed cocking mechanism that can be easily actuated and that provides an alternative actuating option.

This objective is realized with a breech having the characteristics of claim 1 and with a repeating firearm having the characteristics of claim 14. Practical additional developments and advantageous embodiments of the invention form the objects of the dependent claims.

In the inventive breech, the actuating element is realized in the form of a cocking slide that can be displaced between a lower relaxed position and an upper tensioned position on the rear side of the breech block. The cocking mechanism is integrated in the breech block together with the cocking slide and has an extremely compact design. The cocking slide can be pushed forward in order to tension the striking pin spring by simply using thumb pressure. This can be achieved while the hand of the shooter remains on the pistol grip so that the handling of the firearm is simplified. The actuating element that can be easily actuated also makes it possible to delay the cocking process in an ergonomically favorable fashion until shortly before the shot is fired such that the handling and the safety can be improved. Due to the arrangement of the cocking slide on the rear side of the breech block, the cocking slide also can be operated by right-handed or left-handed shooters without requiring any conversion measures.

In one advantageous embodiment, the cocking slide is displaceably guided on an inclined rear wall of the breech block and protrudes through an opening in the inclined rear wall with a lower slide part. In order to prevent soiling, the opening that is realized, e.g., in the form of a slot may be covered with a cover plate or another suitable cover.

According to another preferred embodiment, the cocking mechanism for tensioning and relaxing the striking pin features a sliding sleeve that can be axially moved within the breech block and an actuating lever that is arranged in the breech block and can be turned about a cross pin. The actuating lever preferably features a rounded contact element for contacting a rear face of the sliding sleeve. This makes it possible to minimize the friction between the actuating lever and the sliding sleeve. A simple connection between the actuating lever and the cocking slide can be produced with an intermediate lever in the form of an articulated lever that is coupled to the actuating lever and the cocking slide.

In order to prevent an unintentional actuation of the cocking slide, the cocking slide features a safety device that can be actuated by means of an actuating button or pushbutton and serves for releasably holding the safety slide in the lower relaxed position and the upper tensioned position. An intuitive operation can be achieved in that the actuating button or the pushbutton is arranged in the lower region on the rear side of a triangular upper part of the cocking slide. Such an arrangement furthermore makes it possible to avoid a collision between the thumb knuckle and a sighting telescope, namely even if the sighting telescope is mounted low on the firearm. However, the actuating button or the pushbutton may also be arranged on the front side of a triangular upper part of the cocking slide. The safety device may comprise, e.g., a safety slide that can be actuated by means of the actuating button or the pushbutton and features a cross pin for engaging into latching grooves on the breech block.

In another advantageous embodiment of the invention, the sliding sleeve forms a bolt lock that can be actuated by the cocking slide. The bolt lock may be realized, e.g., in the form of a claw connection between the breech block and the axially movable sliding sleeve in combination with a radial extension on the sliding sleeve that serves for positively engaging into a longitudinal groove on an oblong hole of the bolt assembly. In this way, the bolt can be prevented from turning and therefore opening in the non-cocked state of the firearm. This makes it possible to additionally improve the safety.

BRIEF DESCRIPTION OF THE DRAWINGS

Additional characteristics and advantages of the invention result from the following description of one preferred exemplary embodiment that refers to the drawings. In these drawings.

DETAILED DESCRIPTION OF THE INVENTION

As required, detailed embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the present subject matter in virtually any appropriately detailed structure and function. Further, the terms and phrases used herein are not intended to be limiting, but rather, to provide an understandable description of the concepts.

The terms "a" or "an", as used herein, are defined as one or more than one. The term plurality, as used herein, is defined as two or more than two. The term another, as used herein, is defined as at least a second or more. The terms "including" and "having," as used herein, are defined as comprising (i.e., open language). The term "coupled," as used herein, is defined as "connected," although not necessarily directly, and not necessarily mechanically.

Figure 1:
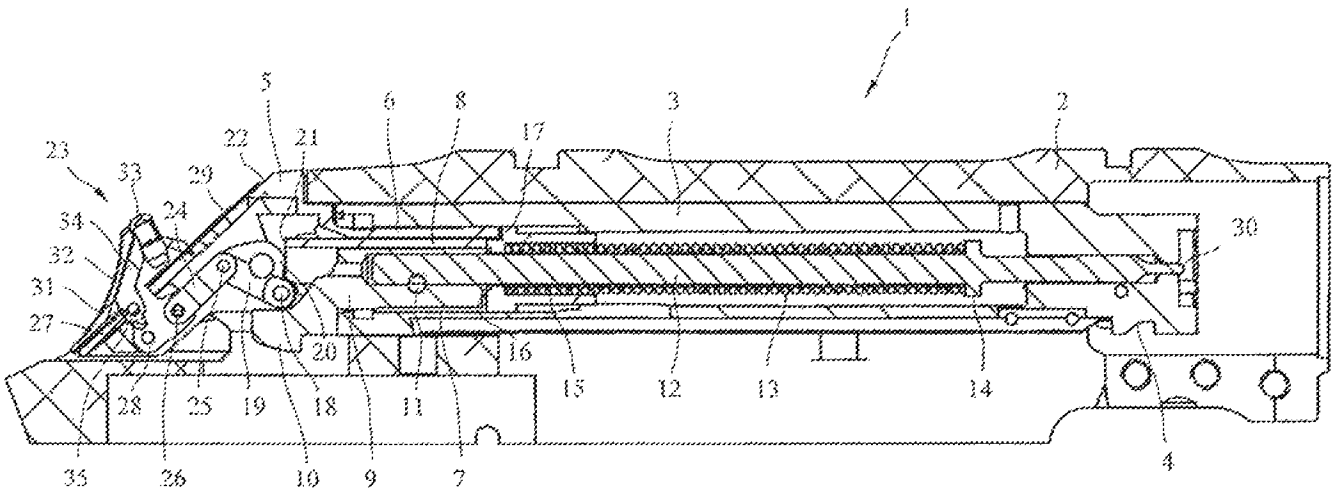
FIG. 1 shows a longitudinal section through a breech of a repeating firearm with a breech block and a cocking mechanism arranged in the breech block.

With reference to the figures, FIG. 1 shows a sectional representation of a breech 1 of a repeating rifle that is realized in the form of a rotary bolt action and features a bolt assembly 3 that is guided within a housing 2 such that it is rotatable about its longitudinal axis and is axially displaceable in the longitudinal direction of the firearm. Locking elements 4 in the form of locking lugs or the like are arranged on the front end of the hollow cylindrical bolt assembly 3 in order to axially lock the bolt assembly 3 in a barrel. A not-shown bolt handle is conventionally arranged on the rear part of the bolt assembly 3 and makes it possible to displace the bolt assembly 3 within the housing 2, as well as to respectively lock and unlock the bolt assembly in the barrel with the locking elements 4 by turning the bolt assembly in order to close the cartridge chamber toward the rear.

A so-called breech block 5 with a sleeve-shaped extension 6 that protrudes into a rear opening of the hollow-cylindrical bolt assembly 3 is arranged on a rear face of the bolt assembly 3. On its rear end, the bolt assembly 3 is axially secured by means of a radial locking mechanism in the form of a bayonet catch and is rotatably connected to the sleeve-shaped extension 6 of the breech block 5 that is secured against turning relative to the housing 2. A sliding sleeve 8 featuring a slot 7 on its underside is guided in the sleeve-shaped extension 6 of the breech block 5 in an axially displaceable fashion.

A cocking piece 9 with a latching extension 10 that protrudes downward through the slot 7 and serves for engaging with a not-shown sear is displaceably guided within the sliding sleeve 8. The not-shown sear holds the cocking piece 9 in the rear position shown when the trigger is not actuated. A cross pin 11 rigidly connects the cocking piece 9 to the rear end of a striking pin 12 that is arranged in the bolt assembly 3 in an axially movable fashion. A striking pin spring 13 seated on the striking pin 12 is tensioned between a front annular collar 14 of the striking pin 10 and a rear thrust sleeve 15.

Figure 2:
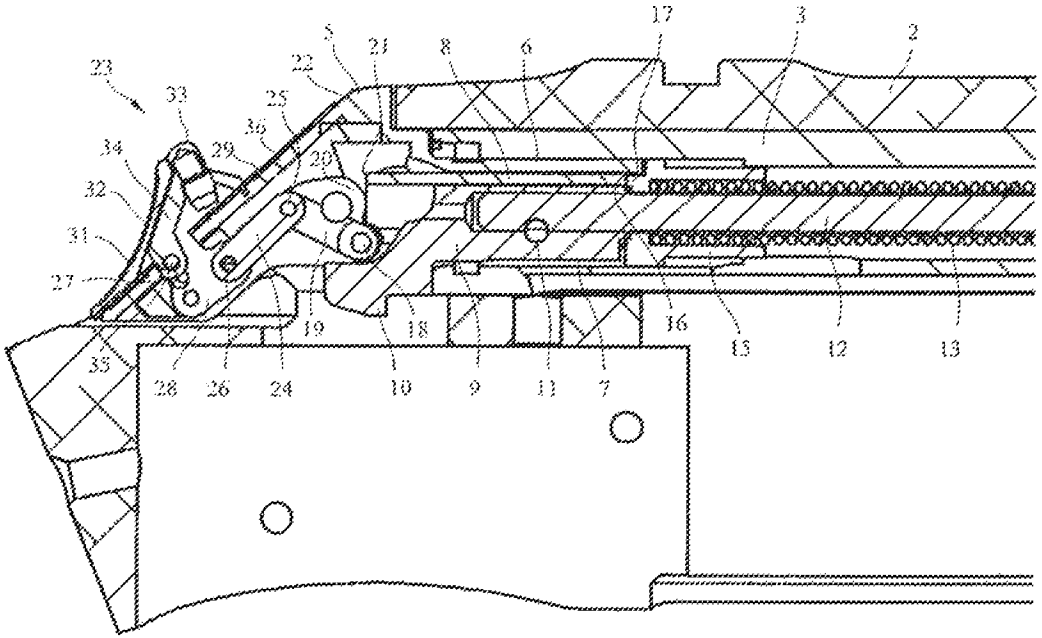
FIG. 2 shows a detail of the cocking mechanism according to FIG. 1 in a relaxed position.
Figure 3:
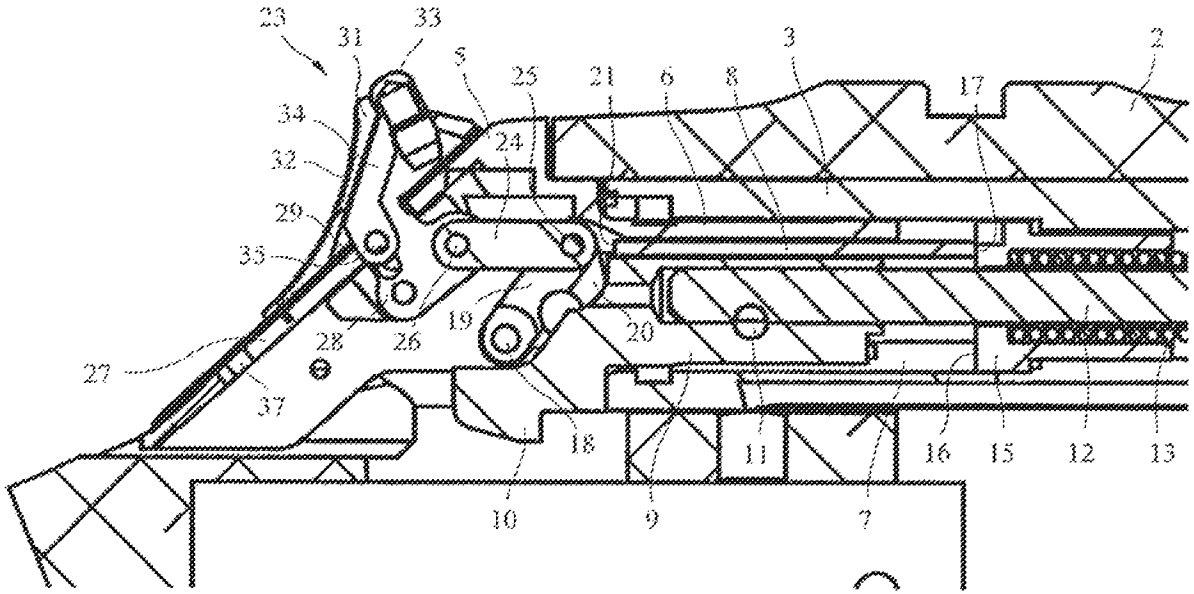
FIG. 3 shows a detail of the cocking mechanism according to FIG. 1 in a tensioned position.

FIGS. 2 and 3, in particular, show that the rear face 16 of the thrust sleeve 15 contacts a front face 17 of the sliding sleeve 8. The sliding sleeve 8 can be displaced by means of a cocking mechanism that is described in greater detail below.

In addition to the sliding sleeve 8 that is displaceably guided in the breech block, the cocking mechanism also comprises an actuating lever 19 that is rotatable within the breech block 5 about a cross pin 18 and features a rounded contact element 20 for contacting a rear face 21 of the sliding sleeve 8. The actuating lever 19 that is rotatable about the cross pin 18 can be turned with a cocking slide 23 that is displaceably arranged in an inclined rear wall 22 of the breech block 5, namely via an intermediate lever 24 in the form of an articulated lever. For this purpose, one end of the intermediate lever 24 in the form of an articulated lever is coupled to the actuating lever 19 by means of a first pivot pin 25 that is spaced apart from the cross pin 18. The other end of the intermediate lever 24 is connected to the cocking slide 23 by means of a second pivot pin 26. In the exemplary embodiment shown, the cocking slide 23 is displaceably guided in a slot-shaped opening 27 in the inclined rear wall 22 of the breech block 5. The second pivot pin 24 [sic; 26] couples the intermediate lever 24 to a lower slide part 28 of the cocking slide 23 that protrudes into the interior of the breech block 5 through the opening 27. The opening 27 in the inclined rear wall 22 of the breech block 5 is covered with a cover plate that can be displaced together with the cocking slide 23 or another suitable cover 29.

A displacement of the cocking slide 23 from the lower relaxed position illustrated in FIG. 2 into the upper tensioned position illustrated in FIG. 3 therefore makes it possible to pivot the actuating lever 19 forward relative to the firing direction via the intermediate lever 24 and to thusly displace the sliding sleeve 8 forward relative to the firing direction. During a forward motion of the sliding sleeve 8, the thrust sleeve 15 is also pushed forward such that the striking pin spring 13 contacts the thrust sleeve 15 with its rear end is tensioned. When the trigger is actuated, the not-shown sear can release the lower latching extension 10 of the cocking piece 9 such that the striking pin 12 can spring forward under the influence of the tensioned striking pin spring 13 and strike a cartridge with its front point 30 in order to fire a shot.

In order to be displaced by the thumb of the shooter, the cocking slide 23 illustrated in an enlarged fashion in FIG. 2 features ribbing 32 on the rear side of its triangular upper part 31 that protrudes upward relative to the inclined rear side 22 of the breech block 5. A safety device in the form of a safety slide 34 that can be actuated by means of an actuating button or pushbutton 33 is accommodated in the cocking slide 23. The safety slide 34 is displaceably guided within the cocking slide 23 and features a cross pin 35 on its lower end that protrudes inward through the opening 27 of the breech block 5 in order to engage in upper latching grooves 36 or lower latching grooves 37 on the sides of the opening 27 that are visible in FIG. 3.

In the relaxed position according to FIG. 2, the cross pin 35 on the lower end of the safety slide 34 that is pressed upward by a spring engages in the lower latching grooves 36 such that an unintentional displacement of the cocking slide 23 into the tensioned position is prevented. The cross pin 35 is only released from the lower latching grooves 36 such that the cocking slide 23 can be pushed upward into the tensioned position illustrated in FIG. 3 when the safety slide 34 is pressed downward against the force of the not-shown spring with the aid of the pushbutton 33. If the pushbutton 33 is released in the upper tensioned position, the cross pin 35 engages in the upper latching grooves 37 such that the cocking slide 23 is also locked in the upper tensioned position. In order to relax the cocking slide, it is initially required to depress the pushbutton 33 in the locked upper tensioned position such that the cocking slide 23 can reach the lower relaxed position. The pushbutton 33 is arranged within the safety slide 34 on the front side of the triangular upper part 31 such that unintentional disengagement of the safety is prevented.

Figure 4:
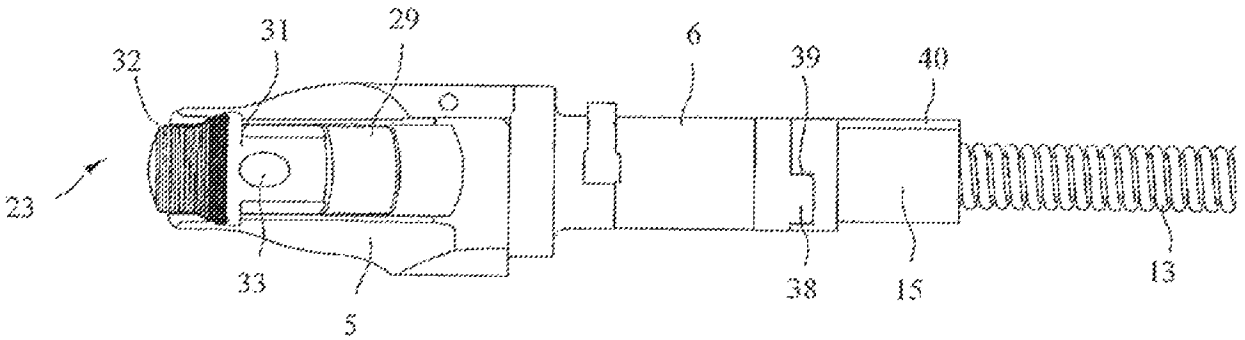
FIG. 4 shows a top view of the breech block according to FIG. 1 with a cocking slide.
Figure 5:
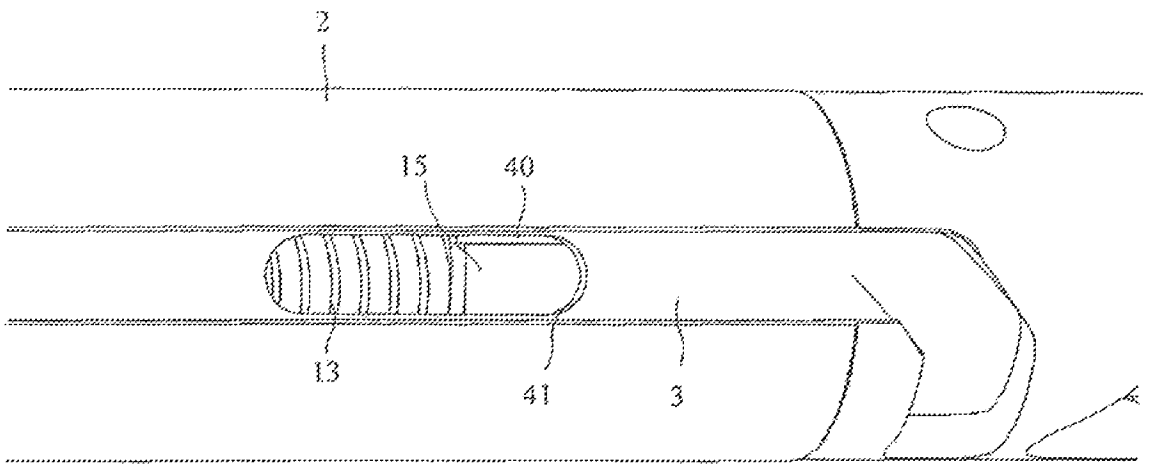
FIG. 5 shows a detail of a connection between a bolt assembly and a thrust sleeve of the breech according to FIG. 1.

FIG. 4 shows that a claw connection is produced between the extension 6 of the breech block 5 and the thrust sleeve 15 that can be displaced with the aid of the sliding sleeve 8. For this purpose, forwardly protruding extensions 38 are provided on the front face of the extension 6 in order to engage in corresponding grooves 39 in the rear face of the thrust sleeve 15. On its outer side, the thrust sleeve 15 furthermore features a radial shoulder 40 for engaging in a longitudinal groove arranged on the inner side of an oblong hole 41 of the hollow-cylindrical bolt assembly 3. Due to the engagement of the shoulder 40 in the longitudinal groove formed by the oblong hole 41, a connection is produced that is secured against turning, but allows an axial displacement between the bolt assembly 3 and the thrust sleeve 15. However, the thrust sleeve 15 is rotatable only if it has been displaced forward by the sliding sleeve 8 by such a distance that the grooves 39 are disengaged from the claws of the breech block 5. This can be achieved by slightly pushing the cocking slide 23 forward such that the thrust sleeve 15 is moved forward relative to the breech block 5 by means of the sliding sleeve 8 and the actuating lever 24. The bolt assembly 3 can be turned in order to thusly open the breech only once this has taken place. However, if the cocking slide 23 is in the lower relaxed position, the extensions 38 are engaged with the grooves 39 such that the bolt assembly 3 cannot be turned and the breech cannot be opened. In this way, a bolt lock is realized in order to prevent the breech from being unintentionally opened.

Figure 6:
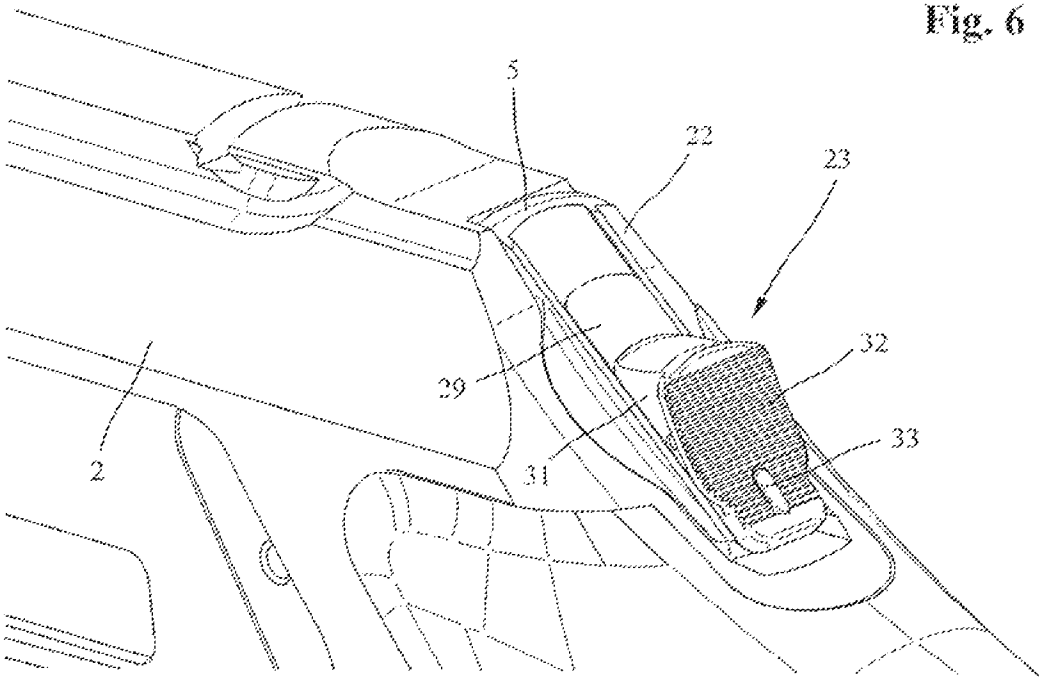
FIG. 6 shows a perspective representation of a breech block that is arranged on the rear side of a housing and features a cocking slide that is illustrated in a lower relaxed position.
Figure 7:
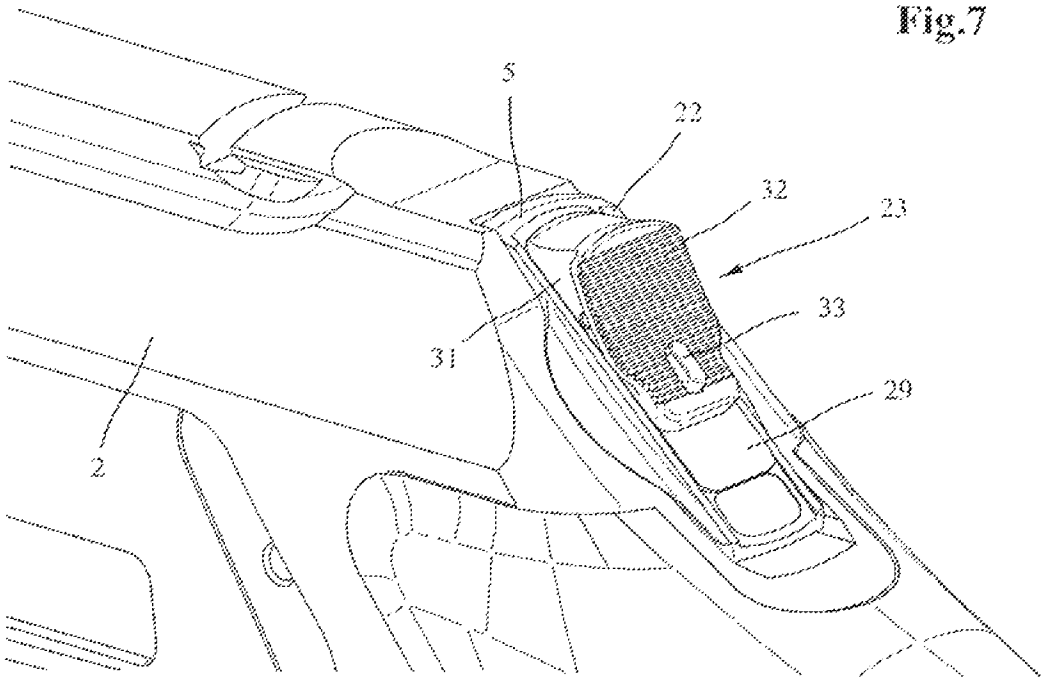
FIG. 7 shows a perspective representation of the breech block according to FIG. 6, in which the cocking slide is illustrated in an upper tensioned position.

FIGS. 6 and 7 show another exemplary embodiment of a cocking slide 23 that is displaceably arranged in an inclined rear wall 22 of the breech block 5 and features an actuating button or pushbutton 33 for actuating the safety device. In this case, the cocking slide 23 also protrudes through an opening that is not visible in these figures and that is covered with a cover plate or another suitable cover 29 with a lower slide part. The cocking slide 23 also features a triangular upper part 31 that protrudes upward relative to the inclined rear side 22 of the breech block 5 and is provided with ribbing 32 on its rear side such that the cocking slide 23 can be displaced with the thumb of the shooter. In contrast to the exemplary embodiment according to FIGS. 1 to 5, the actuating button or pushbutton 33 is not arranged on the front side of the triangular upper part 31, but rather in the lower region on the rear side provided with ribbing 32.

When the cocking slide 23 illustrated in FIGS. 6 and 7 is displaced from the lower relaxed position illustrated in FIG. 6 into the tensioned position illustrated in FIG. 7 with the aid of the thumb, the operator feels the pressure increase of the actuating button or pushbutton 33 during the course of the tensioning process. Due to the arrangement of the actuating button or pushbutton 33 in the lower region of the upper part 31, however, the actuating button or pushbutton 33 presses into the soft part of the first segment of the thumb and therefore is not actuated. In the tensioned position illustrated in FIG. 7, the actuating button or pushbutton 33 protrudes relative to the ribbing 32 and is perceived as an actuating element. In the upper tensioned position, the actuating button or pushbutton 33 can be actuated with the harder front part of the first segment of the thumb in order to disengage the lock and release the cocking slide 23 such that it can be displaced into the lower relaxed position.

It will be appreciated by persons skilled in the art that the present disclosure is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the disclosure.

All references cited herein are expressly incorporated by reference in their entirety. In addition, unless mention was made above to the contrary, it should be noted that all of the accompanying drawings are not to scale. There are many different features to the present disclosure and it is contemplated that these features may be used together or separately. Thus, the disclosure should not be limited to any particular combination of features or to a particular application of the disclosure. Further, it should be understood that variations and modifications within the spirit and scope of the disclosure might occur to those skilled in the art to which the disclosure pertains. Accordingly, all expedient modifications readily attainable by one versed in the art from the disclosure set forth herein that are within the scope and spirit of the present disclosure are to be included as further embodiments of the present disclosure.

What is claimed is:

1. A breech for a repeating firearm comprising:

a bolt assembly that is guided within a housing such that the bolt assembly is rotatable about a longitudinal axis of the bolt assembly and is axially displaceable in a longitudinal direction of the firearm;

a striking pin that is axially movable in the bolt assembly; and a breech block that is arranged on a rear side of the bolt assembly and in which a cocking mechanism is accommodated that is actuatable with an actuating element and serves for tensioning and relaxing a striking pin spring acting upon the striking pin, wherein the actuating element includes a cocking slide that is slidingly displaceable along an inclined rear wall of the breech block between a lower relaxed position and upper tensioned position on a rear side of the breech block and wherein the lower relaxed position is located a first vertical distance from the longitudinal axis of the bolt assembly and the upper tensioned position is located a second vertical distance from the longitudinal axis of the bolt assembly, with the first vertical distance being different than the second vertical distance.

2. The breech according to claim 1, wherein the cocking slide includes a lower slide part and the lower slide part protrudes through an opening in the inclined rear wall of the breech block.

3. The breech according to claim 2, wherein the opening is covered with a cover.

4. The breech according to claim 1, wherein the cocking mechanism includes a sliding sleeve that is axially moveable within the breech block and an actuating lever that is arranged in the breech block such that the actuating lever is turnable about a cross pin and serves for tensioning and relaxing the striking pin spring.

5. The breech according to claim 4, wherein the actuating lever includes a rounded contact element for contacting a rear face of the sliding sleeve.

6. The breech according to claim 4, wherein the actuating lever is connected to the cocking slide in an articulated fashion by an intermediate lever.

7. The breech according to claim 4, wherein the sliding sleeve forms a bolt lock that is actuatable by the cocking slide.

8. The breech according to claim 7, wherein the bolt lock includes a claw connection between the breech block and the axially movable sliding sleeve in combination with a radial extension on the sliding sleeve that serves for positively engaging in a longitudinal groove on an oblong hole of the bolt assembly.

9. A repeating firearm including the breech of claim 4.

10. The breech according to claim 1, wherein the cocking slide includes a safety device that is actuatable by an actuating button or a pushbutton and serves for releaseably holding the cocking slide in the lower relaxed position and the upper tensioned position.

11. The breech according to claim 10, wherein the actuating button or pushbutton is arranged in a lower region on a rear side of a triangular upper part of the cocking slide.

12. The breech according to claim 10, wherein the actuating button or pushbutton is arranged on a front side of a triangular upper part of the cocking slide.

13. The breech according to claim 10, wherein the safety device includes a safety slide that is actuatable by the actuating button or the pushbutton and includes a cross pin for engaging in latching grooves on the breech block.

14. A repeating firearm including the breech of claim 10.

15. A repeating firearm including the breech of claim 1.

16. A breech for a repeating firearm comprising:

a bolt assembly that is guided within a housing such that the bolt assembly is rotatable about a longitudinal axis of the bolt assembly and is axially displaceable in a longitudinal direction of the firearm;

a striking pin that is axially movable in the bolt assembly; and a breech block that is arranged on a rear end of the bolt assembly and in which a cocking mechanism is accommodated that is actuatable with an actuating element and serves for tensioning and relaxing a striking pin spring acting upon the striking pin, wherein the actuating element includes a cocking slide that is slidingly displaceable along a longitudinal direction of the breech between a lower relaxed position and an upper tensioned position on a rear side of the breech block.

17. A repeating firearm including the breech of claim 16.

18. The breech according to claim 16, wherein the cocking slide is slidingly displaceable along an inclined rear wall of the breech block between the lower relaxed position and the upper tensioned position on the rear side of the breech block.

19. A breech for a repeating firearm comprising:

a bolt assembly that is guided within a housing such that the bolt assembly is rotatable about a longitudinal axis of the bolt assembly and is axially displaceable in a longitudinal direction of the firearm;

a striking pin that is axially movable in the bolt assembly; and a breech block that is arranged on a rear end of the bolt assembly and in which a cocking mechanism is accommodated that is actuatable with an actuating element and serves for tensioning and relaxing a striking pin spring acting upon the striking pin, wherein the actuating element includes a cocking slide that is slidingly displaceable and guided on an inclined rear wall along a longitudinal direction of the breech from a lower relaxed position and an upper tensioned position on a rear side of the breech block.

20. The breech according to claim 19, wherein the cocking slide includes a safety device that is actuatable by an actuating button or a pushbutton and serves for releaseably holding the cocking slide in the lower relaxed position and the upper tensioned position.

* * * * *